US006383011B2

(12) United States Patent
Chen

(10) Patent No.: US 6,383,011 B2
(45) Date of Patent: May 7, 2002

(54) STRUCTURE FOR INTERLOCKING CONNECTORS

(75) Inventor: Ping Chen, West Bloomfield, MI (US)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/791,829

(22) Filed: Feb. 26, 2001

(30) Foreign Application Priority Data

Mar. 13, 2000 (JP) ..... 2000-068123

(51) Int. Cl.[7] ..... H01R 13/627
(52) U.S. Cl. ..... 439/358; 439/357
(58) Field of Search ..... 439/358, 357, 439/352, 353, 354, 350, 488, 489, 351, 355

(56) References Cited

U.S. PATENT DOCUMENTS 4,871,325 A * 10/1989 Maejima et al. ..... 439/353
4,986,766 A * 1/1991 Leonard et al. ..... 439/352
5,112,246 A * 5/1992 Kawase et al. ..... 439/489
5,254,014 A * 10/1993 Yagi et al. ..... 439/353
5,378,168 A * 1/1995 Sumida ..... 439/358
5,910,027 A * 6/1999 Wayt et al. ..... 439/489
5,919,056 A * 7/1999 Suzuki et al. ..... 439/352
5,938,470 A * 8/1999 Kashiyama ..... 439/489
6,059,597 A * 5/2000 Endo et al. ..... 439/352
6,257,922 B1 * 7/2001 Shinozaki et al. ..... 439/489

* cited by examiner

*Primary Examiner*—Gary Paumen
*Assistant Examiner*—Ross Gushi
(74) *Attorney, Agent, or Firm*—Antonelli, Terry, Stout & Kraus, LLP

(57) ABSTRACT

A structure for interlocking connectors improves rigidity of a push lever as well as mutual retention and mechanical strength to a proper extent, and increases the feeling of click when they are engaged with each other, further protecting the lever to be caught by foreign wire ends. The connectors are a male connector (1) and a female connector (2) to be fitted on the male connector, and a lockable lug (7) is formed on the outer surface of one of connector housings (3). A lock arm (15) integral with a pawl (16) engaging with the lockable lug (7) is secured above the outer surface of the other connector housing (4), by a pair of elastically deformable hinge-shaped feet (17). The push lever (18) is disposed on a rear end of the lock arm (15) extending rearwards beyond the feet (17). The lever (18) and a pair of bridging members (19) continuing from opposite lateral ends of the lever and integrally fixed on side walls of the housing (4) serve as an arch-shaped guard for the interlocking structure.

2 Claims, 4 Drawing Sheets

STRUCTURE FOR INTERLOCKING CONNECTORS

BACKGROUND OF THE INVENTION

The present invention relates to a structure for interlocking a female connector with a male connector fitting therein.

As the prior art, various types of structures for interlocking connectors have been known, and one example is shown in FIGS. 6 and 7. In this structure for interlocking connectors, one connector housing (base) 23 has a lockable lug 27 formed on the outer surface thereof. The other connector housing 24 has a lock arm 25 that is formed integral with a pawl 26 capable of engaging with the lockable lug 27, wherein elastically deformable hinge-shaped feet 37 secure the lock arm 25 to an outer surface of the other housing 24. This connector housing 24 also has a push lever 28 formed on the rear end of the lock arm 25, to be disposed rearwardly of hinge-shaped feet 37. In these figures of the drawings, the reference numeral 30 denotes post contacts that are insert-molded in the connector housing (base) 23 so as to penetrate it, and the numeral 32 denotes socket contacts for electrical connection with the post contacts 30. Each socket contact 32 is crimped on a wire end 31 before being put in a receptacle cavity 29 of the connector housing 24.

The prior art locking system is simple in structure and easy to connect and disconnect the housings 23 and 24 to or from each other, enabling wide use for internal electrical connections within various electronic devices or apparatuses.

The interlocking portions of the connectors in the described prior art structure are not necessarily sufficient in their mutual retention and in their own mechanical strength. The prior art structure has thus often failed to ensure reliable electrical connections, when used in certain vibrating machines such as automobiles. 'Snap-fit' feeling has scarcely been produced when engaging the lockable lug 27 with the lock arm 25, so that unfortunately their mutual connection has considerably been difficult to confirm from outside. If however the mutual retention and mechanical strength of those lug 27 and arm 25 in the connectors are designed to be excessively high, then they could not easily engage with or disengage from each other.

As seen in FIG. 7 showing the above structure in use, a gap 'S' is present between the push lever 28 and the outer surface of the connector housing 24, with the push lever being formed as a rear end portion of the lock arm 25 as mentioned above. Due to such a gap, electric wire ends involved in adjacent harnesses have often pressed undesirably the push lever 28 and unlock the lockable lug 27 out of the lock arm 25. This drawback has been most prominent in case of arranging a number of electric wire ends within a narrow space such as those available in automobiles. In addition, electric wire ends of the neighboring harnesses have sometimes got in the gap 'S' to be jammed therein, accidentally catching the push lever 28 and hindering the wiring operations.

SUMMARY OF THE INVENTION

The present invention was made in view of the drawbacks inherent in the prior art structure. An object of the invention is therefore to provide an improved structure for interlocking electric connectors with each other, the improvement residing in that a push lever in the structure is of an increased rigidity to moderately enforce mutual retention and raise mechanical strength of the connectors. The improvement has also to be such that 'snap-fitting' of said connectors can surely be felt by a user or operator when they mate one another, and foreign wires are protected from being got caught in the push lever.

In order to achieve the object, the present invention provides a structure for interlocking connectors with each other, the connectors being a male connector and a female connector to be fitted thereon, the structure comprising a housing of one of the connectors, and a lockable lug formed on an outer surface of the one connector. The structure further comprises a housing of the other connector, and a lock arm integral with a pawl corresponding to and engageable with the lockable lug, the lock arm being formed on an outer surface of the other connector housing. The structure still further comprises a pair of elastically deformable hinge-shaped feet having one end integral with the other connector housing and having another end continuing from the lock arm, and a push lever having lateral ends formed integral with a rear end of the lock arm extending rearwardly beyond the hinge-shaped feet. Characteristically, the structure yet still further comprises a pair of bridging members that continue from opposite side walls of the other connector housing so as to be integral with the lateral ends of the push lever such that an arch-shaped or gate-shaped lock guard portion is provided above the other connector housing.

Each of the bridging members disposed beside the push lever may be of a curved shape.

In the above interlocking structure, all the hinge-shaped feet and the pair of bridging members may be designed to be of a moderate bending strength (elasticity) in order that rigidity of the push lever as well as mutual retention and mechanical strength of the locking structure are improved without adversely affecting easiness of connecting the connectors with each other or disengaging them from each other. Further, the bridging members integrally formed with both sides of the connector housing will guard the push lever. Any adjacent foreign wire ends will no longer catch or move the push lever, thus protesting the lock arm from any unintentional disengagement from the lug.

THE PREFERRED EMBODIMENTS

Figure 1:
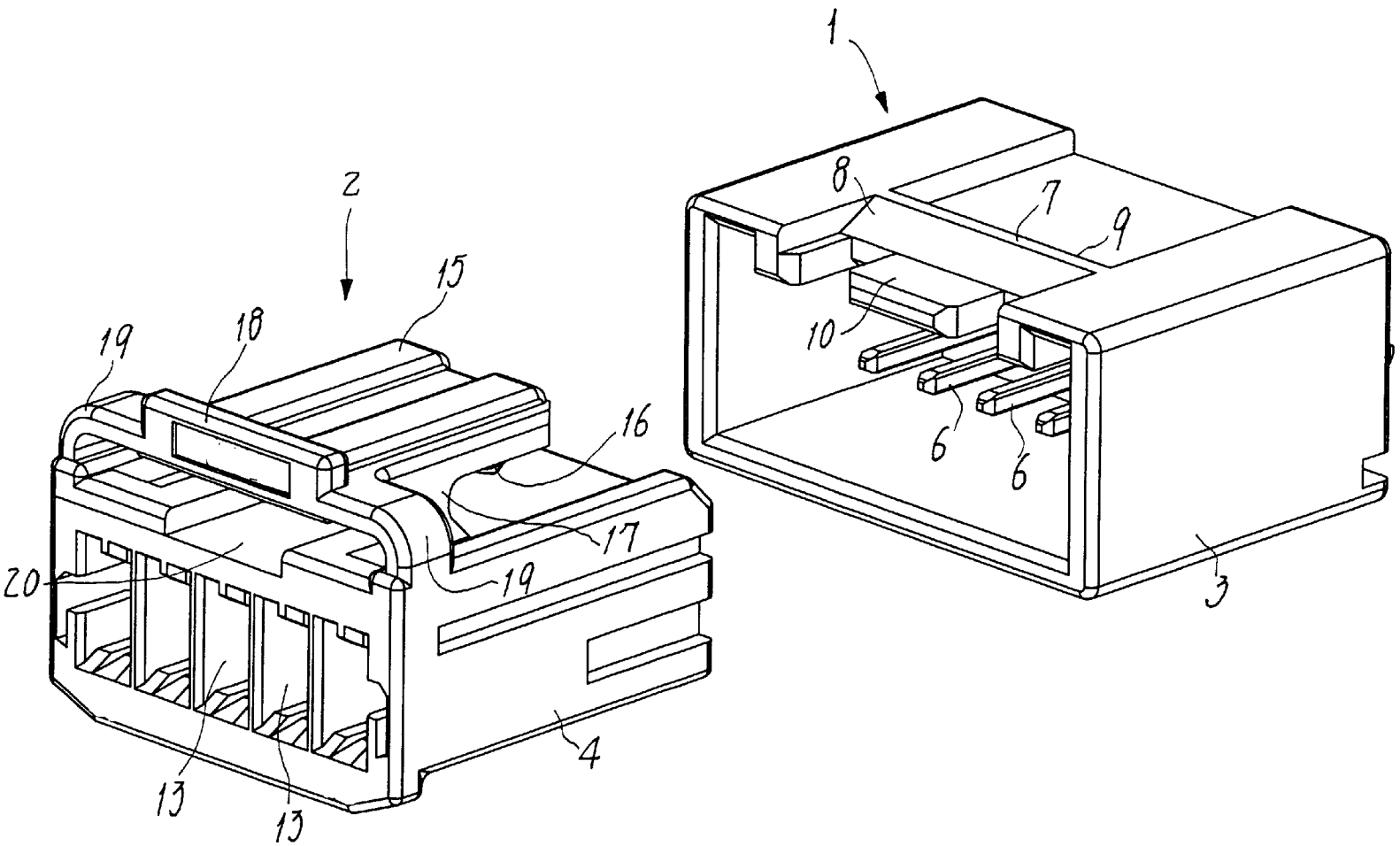
FIG. 1 is a perspective view of a pair of connectors disengaged from but engageable with each other by a locking structure provided in an embodiment of the present invention.
Figure 2:
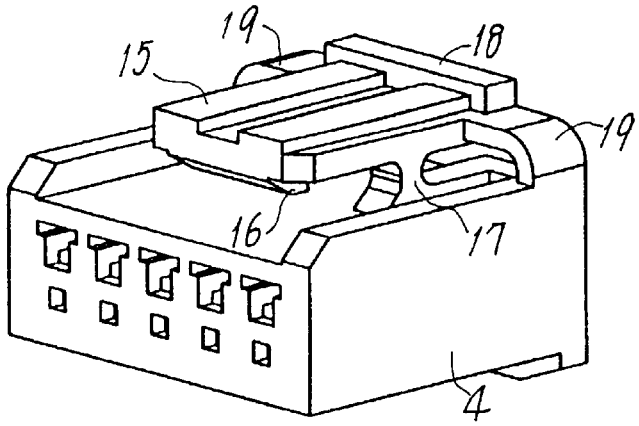
FIG. 2 is a perspective view of a female connector housing seen from the front the side thereof.

Now some embodiments of the present invention will be described referring to the drawings.

FIG. 1 shows a pair of connectors that are a male connector 1 and a female connector 2 to be fitted thereon, with each connector having an interlocking structure of the present invention. The connectors 1 and 2 respectively comprise housings 3 and 4 that are made of an insulating resin such as Nylon (a registered trademark).

The housing 3 of the male connector 1 (hereinafter referred to as a first connector housing) is generally a parallelepiped box having an open front face. A plurality of post contacts 6 penetrating a bottom 5 (see FIG. 5) of the first connector housing are secured therein. The first connector housing 3 has, on its outer surface, a slope 8 slanted forwards and downwards and a shoulder 9 vertically extending downwards from a rear end of the slope. The slope 8 and the shoulder 9 define together a generally upright lockable lug 7. In addition, a guiding projection 10 for positioning the male connector in correct place continues forwards from a frontal face of the lockable lug 7.

Figure 3:
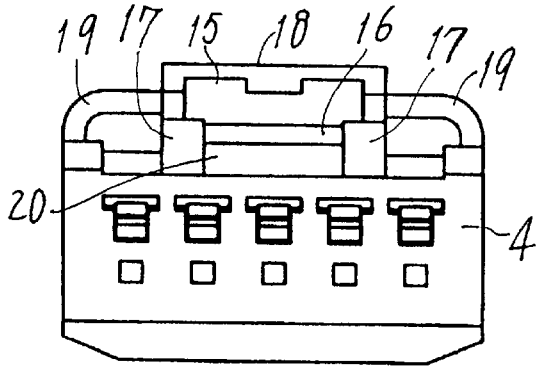
FIG. 3 is a front elevation of the female connector housing.
Figure 4:
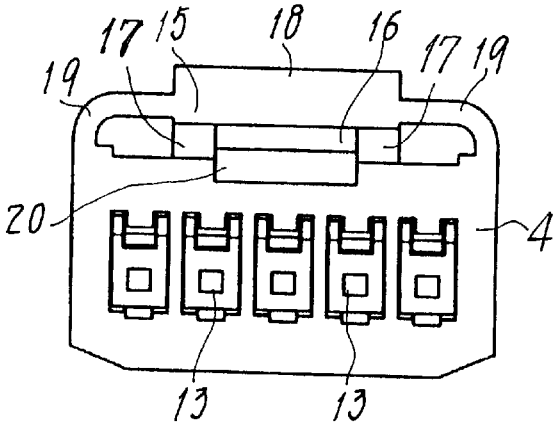
FIG. 4 is a rear elevation of the female connector housing.
Figure 5:
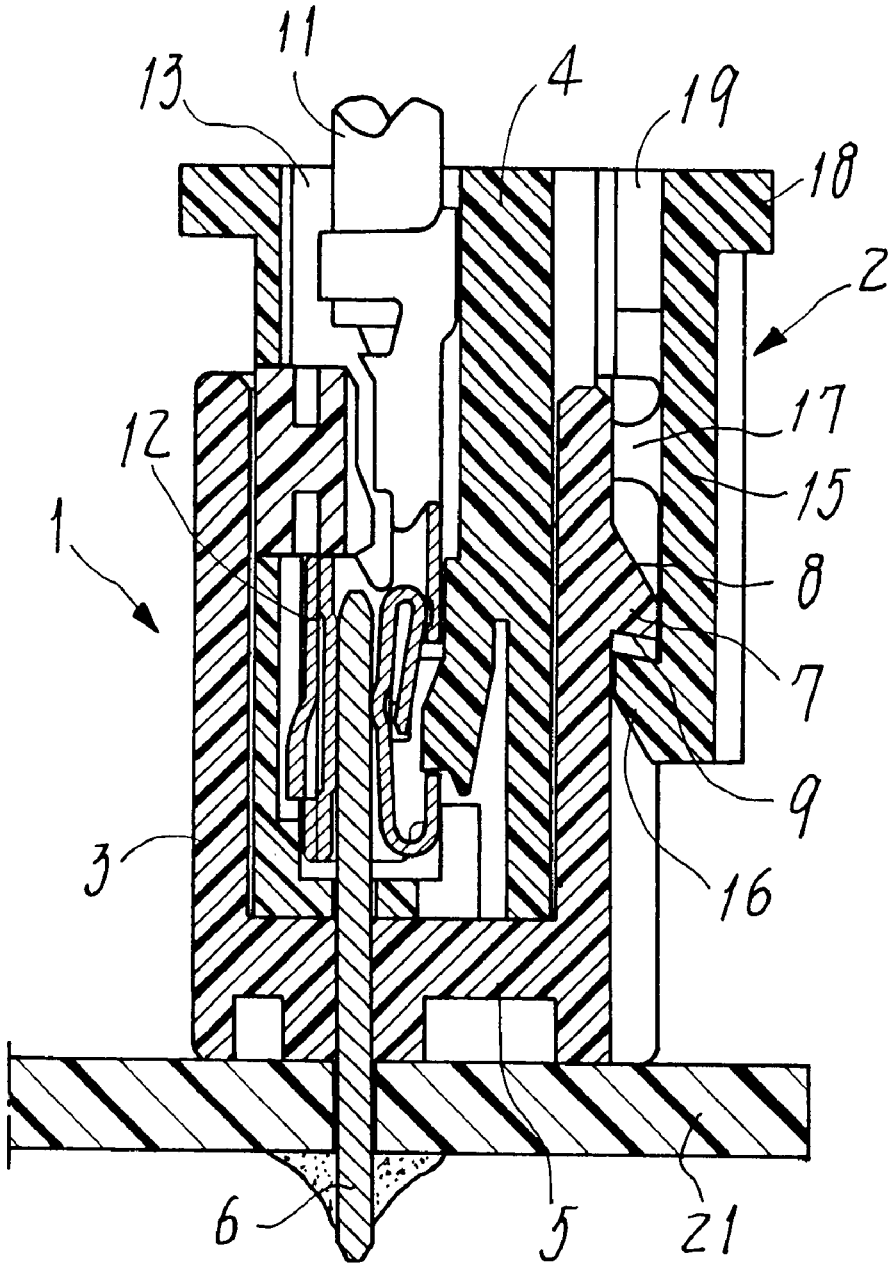
FIG. 5 is a front elevation of the pair of connectors in use that are shown in vertical cross sections.
Figure 6:
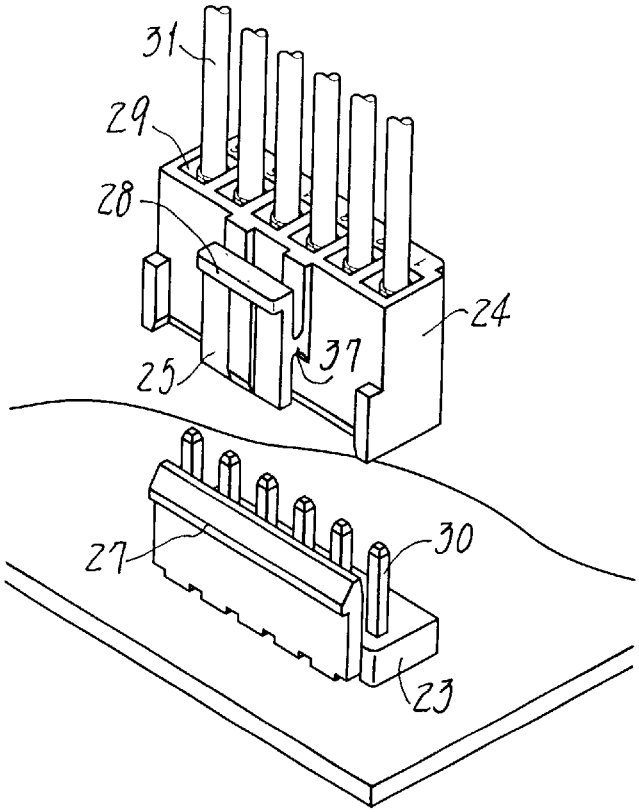
Fig.6 (PRIOR ART)
FIG. 6 is a perspective view of a pair of the prior art connectors shown in use.
Figure 7:
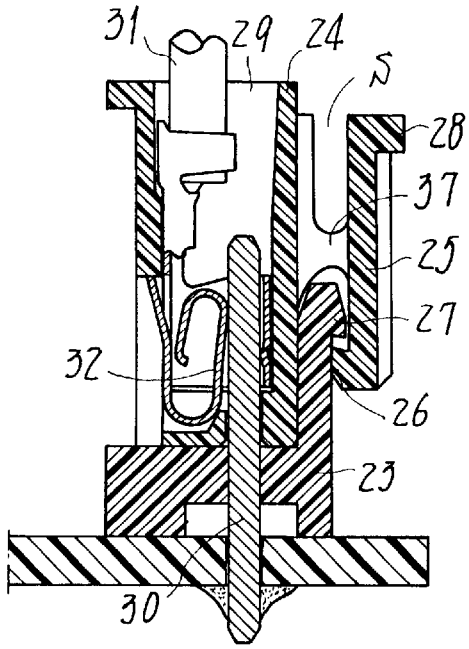
Fig.7 (PRIOR ART)
FIG. 7 is a front elevation of the prior art connectors in use that are shown in vertical cross sections.

On the other hand, the female connector 2 comprises the housing 4 (hereinafter referred to as a second connector housing) is also a parallelepiped fittable on the first connector housing 3. The housing 4 has a plurality of compartments 13 penetrating it and corresponding to the male connector's 1 post contacts 6 so as to receive socket contacts 12. Those socket contacts will have been crimped on respective wire ends 11 as shown in FIG. 5. On an outer surface of the second connector housing 4, a flat lock arm 15 is formed with a hook-shaped pawl 16 that is disposed at a free end of said arm so as to engage with the lockable lug 7 of the first connector housing 3. Two elastically deformable hinge-shaped feet 17 (see FIGS. 3 and 4) integral with the lock arm 15 serve to secure it on the outer surface of the second housing 4. A push lever 18 protruding upwards is additionally formed at a rear end of the lock arm 15 that extends backwards beyond the hinge-shaped feet 17. The push lever 18 is intended to be pressed down by the operator with his or her finger or fingers so that the lock arm 15 will pivot on the hinge-shaped feet 17. Further, both the lateral ends of the push lever 18 are firmly adjoined a pair of elastically deformable bridging members 19 that are integral with and continue from the respective side walls of the second connector housing 4. In detail, the bridging members 19 extend sideways and outwards at first from the respective ends of the push lever 18, and then curve downwards to be integral with the side walls of the second connector housing 4. The push lever 18 and the bridging members 19 do form an arch-shaped lock guard above the rear end of the second housing 4. Thus, a loop is defined by and along the push lever 18, the body of the second housing 4 and the pair of the bridging members 19, so as to serve as a guard for said lever 18. Disposed below the push lever 18 is a guide groove 20 facing and engageable with the guiding projection 10, so that the latter of the first housing 3 can take a correct position in the second housing 4.

It is noted here that by employing the hinge-shaped feet 17 and the bridging members 19 all of a proper bending strength (elasticity), rigidity of the push lever 18 can be raised to improve mutual retention and mechanical strength of the locking members described above, without adversely affecting easiness in detachably attaching the connectors 1 and 2 to each other.

FIG. 5 shows the connectors of the described structure and their positions in use. The second connector housing 4 of the female connector 2 having their socket contacts 12 crimped on wire ends 11 will be coupled with the first connector housing 3 of the male connector 1 surface-mounted on a printed circuit board 21. Consequently, each post contact 6 will fit in the socket contact 12 to be electrically connected to each other, with the pawl 16 of the lock arm 15 simultaneously engaging with the lockable lug 7 of the first housing 3 to thereby interlock the connector housings 3 and 4 with each other. In detail, the guiding projection 10 of the first housing 3 will be set in place thanks to its engagement with the guide groove 20, before pawl 16 of the lock arm 15 moves along the slope 8 of the lockable lug 7 and consequently the arm 15 pivots outwards on the hinge-shaped feet 17. Such an outward pivoting of the lock arm 15 will allow the pawl 16 to slide over the slope 8, causing elastic recovery of the arm 15 to bring the shoulder 9 of the lug 7 into a normally non-releasable engagement with the pawl 16. By virtue of a click that will accompany such an engagement of the housing 3 with the housing 4, the user or operator can surely know the establishment of a correct mutual interlocking connection of these housing.

The housing 4 of the female connector 2 may be disengaged from the connector housing 3 of the male connector 1, if necessary after or during use of the electronic or electric device. In this case, the user or operator need to just press the push lever 18 to elastically deform the bridging members 19 so as to swing the lock arm 15 outwards a little around the hinge-shaped feet 17. As a result, the pawl 16 will be freed from the lockable lug 7 to make it possible to unlock and pull the second connector housing 4 out of the first connector housing 3.

In summary, the lock arm in the present invention described above is held in place by the elastically deformable hinge-shaped feet and the pair of elastically deformable bridging members. The bridging members are disposed respectively on and continue from the opposite lateral ends of the push lever, which lever in turn is formed as the rear end portion of the lock arm. The hinge-shaped feet and the bridging members are designed to be of a proper bending strength (elasticity) to raise rigidity of the push lever to such a degree that the connectors can still be engaged with and disengaged from each other. By virtue of this feature, mutual retention and holding strength of the connectors are now improved on one hand, and the clicking of them being snugly fitted one in another is now more clearly detected by the user or operator.

Furthermore, the bridging members having their one ends connected to lateral sides of the push lever do have their other ends made integral with the side walls of the housing body. The arch-shaped lock guard thus formed above the rear end of said housing body thus provides a loop extending through the push lever and the housing body. This loop will not only guard the push lever but also will prevent the wires in another harness from catching and/or moving the lever to unintentionally release the lock arm.

What is claimed:

1. A structure for interlocking connectors with each other, the connectors being a male connector and a female connector to be fitted thereon, the structure comprising:

a housing of one of the connectors;

a lockable lug formed on an outer surface of the one connector;

a housing of the other connector;

a lock arm integral with a pawl corresponding to and engageable with the lockable lug, the lock arm being formed on an outer surface of the other connector housing;

a pair of elastically deformable hinge-shaped feet each having one end integral with the other connector housing and another end continuing from the lock arm; and a push lever having lateral ends formed integral with a rear end of the lock arm extending rearwardly beyond the hinge-shaped feet, the structure further comprising:

a pair of bridging members that continue from opposite side walls of the other connector housing so as to be integral with the lateral ends of the push lever such that an arch-shaped lock guard portion is provided above the other connector housing.

2. A structure for interlocking connectors as defined in claim 1, wherein each bridging member is of a curved shape.

* * * * *